US009004151B2

(12) United States Patent
Waniuk et al.

(10) Patent No.: US 9,004,151 B2
(45) Date of Patent: Apr. 14, 2015

(54) TEMPERATURE REGULATED MELT CRUCIBLE FOR COLD CHAMBER DIE CASTING

(71) Applicant: Apple Inc., Cupertino, CA (US)

(72) Inventors: Theodore A. Waniuk, Lake Forest, CA (US); Joseph Stevick, Olympia, WA (US); Sean Timothy O'Keeffe, Tustin, CA (US); Dermot J. Stratton, San Francisco, CA (US); Joseph C. Poole, San Francisco, CA (US); Matthew S. Scott, San Jose, CA (US); Christopher D. Prest, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/628,556

(22) Filed: Sep. 27, 2012

(65) Prior Publication Data

US 2014/0083638 A1 Mar. 27, 2014

(51) Int. Cl.
*B22D 41/005* (2006.01)
*F27B 14/06* (2006.01)

(52) U.S. Cl.
CPC ..... *B22D 41/005* (2013.01); *F27B 14/061* (2013.01)

(58) Field of Classification Search
CPC ..... H05B 6/24; H05B 6/26
USPC ..... 164/335, 336, 513, 493, 507; 266/241, 266/242
See application file for complete search history.

(56) References Cited

U.S. PATENT DOCUMENTS

| | | | | | |
|---|---|---|---|---|---|
| 3,671,029 | A | | 6/1972 | Karlsson et al. | |
| 3,731,727 | A | | 5/1973 | Mitamura et al. | |
| 3,916,047 | A | * | 10/1975 | Niesen | 428/34.1 |
| 4,040,845 | A | | 8/1977 | Richerson et al. | |
| 4,135,568 | A | | 1/1979 | Brooks | |
| 4,138,096 | A | * | 2/1979 | Boucher et al. | 266/240 |
| 4,265,294 | A | | 5/1981 | Gaule et al. | |
| 4,411,412 | A | * | 10/1983 | Lechevallier | 266/242 |
| 4,550,412 | A | | 10/1985 | Holcombe et al. | |

(Continued)

FOREIGN PATENT DOCUMENTS

| | | |
|---|---|---|
| DE | 19902002 | 7/2000 |
| EP | 0845316 | 6/1998 |

(Continued)

OTHER PUBLICATIONS

Inoue et al., "Bulk amorphous alloys with high mechanical strength and good soft magnetic properties in Fe-Tm-B(TM=IV-VIII group transition metal) system", Appl. Phys. Lett., vol. 710, p. 464 (1997).

(Continued)

*Primary Examiner* — Kevin E Yoon
(74) *Attorney, Agent, or Firm* — Brownstein Hyatt Farber Schreck, LLP

(57) ABSTRACT

Disclosed is a vessel for melting and casting meltable materials. The vessel may be a surface temperature regulated vessel for providing a substantially non-wetting interface with the molten materials. In one embodiment, the vessel may include one or more temperature regulating channels configured to flow a fluid therein for regulating a surface temperature of the vessel such that molten materials are substantially non-wetting at the interface with the vessel. Disclosed also includes systems and methods for melting and casting meltable materials using the vessel.

17 Claims, 5 Drawing Sheets

(56) References Cited

U.S. PATENT DOCUMENTS

| | | | | |
|---|---|---|---|---|
| 4,612,973 | A | 9/1986 | Whang | |
| 4,678,024 | A | 7/1987 | Hull et al. | |
| 4,693,299 | A | 9/1987 | Kuznetsov et al. | |
| 4,745,620 | A * | 5/1988 | Mortimer | 373/152 |
| 4,799,532 | A | 1/1989 | Mizuhara | |
| 4,887,798 | A | 12/1989 | Julius | |
| 5,003,551 | A | 3/1991 | Mortimer | |
| 5,087,804 | A | 2/1992 | McGaffigan | |
| 5,288,344 | A | 2/1994 | Peker et al. | |
| 5,368,659 | A | 11/1994 | Peker et al. | |
| 5,487,421 | A | 1/1996 | Gerber | |
| 5,616,024 | A | 4/1997 | Nobori et al. | |
| 5,618,359 | A | 4/1997 | Lin et al. | |
| 5,711,363 | A | 1/1998 | Scruggs et al. | |
| 5,735,975 | A | 4/1998 | Lin et al. | |
| 5,860,468 | A * | 1/1999 | Cook | 164/61 |
| 5,896,642 | A | 4/1999 | Peker et al. | |
| 5,976,247 | A | 11/1999 | Hansen et al. | |
| 6,021,840 | A | 2/2000 | Colvin | |
| 6,189,600 | B1 | 2/2001 | Taniguchi et al. | |
| 6,267,170 | B1 | 7/2001 | Onuki et al. | |
| 6,267,171 | B1 | 7/2001 | Onuki et al. | |
| 6,283,197 | B1 | 9/2001 | Kono | |
| 6,325,868 | B1 | 12/2001 | Kim et al. | |
| 6,371,195 | B1 | 4/2002 | Onuki et al. | |
| 6,409,791 | B1 * | 6/2002 | Petit et al. | 75/10.14 |
| 6,427,753 | B1 | 8/2002 | Inoue et al. | |
| 6,875,293 | B2 | 4/2005 | Peker | |
| 7,017,645 | B2 | 3/2006 | Johnson et al. | |
| 7,235,910 | B2 | 6/2007 | Decristofaro et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu et al. | |
| 7,906,219 | B2 | 3/2011 | Ohara et al. | |
| 2002/0005233 | A1 | 1/2002 | Schirra et al. | |
| 2005/0028961 | A1 | 2/2005 | Toyoshima et al. | |
| 2005/0129087 | A1 * | 6/2005 | Brun et al. | 373/155 |
| 2005/0242454 | A1 | 11/2005 | Yuasa et al. | |
| 2006/0042773 | A1 | 3/2006 | Eisen | |
| 2006/0254747 | A1 | 11/2006 | Ishida et al. | |
| 2007/0079907 | A1 | 4/2007 | Johnson et al. | |
| 2007/0280328 | A1 * | 12/2007 | Lee et al. | 373/155 |
| 2008/0118327 | A1 | 5/2008 | Babej et al. | |
| 2008/0135136 | A1 | 6/2008 | Demetriou et al. | |
| 2008/0305387 | A1 | 12/2008 | Murray et al. | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis et al. | |
| 2010/0084052 | A1 | 4/2010 | Farmer et al. | |
| 2010/0098967 | A1 | 4/2010 | Schroers et al. | |
| 2010/0230012 | A1 | 9/2010 | Demetriou et al. | |
| 2010/0300148 | A1 | 12/2010 | Demetriou et al. | |
| 2011/0011750 | A1 | 1/2011 | Lovens et al. | |
| 2011/0079940 | A1 | 4/2011 | Schroers et al. | |
| 2011/0094705 | A1 * | 4/2011 | Kelly et al. | 164/493 |
| 2011/0108231 | A1 | 5/2011 | Zheng et al. | |
| 2012/0111523 | A1 * | 5/2012 | Bochiechio et al. | 164/113 |

FOREIGN PATENT DOCUMENTS

| | | |
|---|---|---|
| EP | 1013363 | 6/2000 |
| EP | 1415740 | 5/2004 |
| FR | 2665654 | 2/1992 |
| GB | 392764 | 5/1933 |
| GB | 574914 | 1/1946 |
| GB | 784363 | 10/1957 |
| JP | 55036033 | 3/1980 |
| JP | 6212205 | 8/1994 |
| JP | 8013111 | 1/1996 |
| JP | 9272929 | 10/1997 |
| JP | 2000024767 | 1/2000 |
| JP | 2000326065 | 11/2000 |
| JP | 2001071113 | 3/2001 |
| JP | 2001259821 | 9/2001 |
| JP | 2001303218 | 10/2001 |
| JP | 2004050269 | 2/2004 |
| JP | 2006289466 | 10/2006 |
| JP | 2009068101 | 4/2009 |
| JP | 2009172627 | 8/2009 |
| JP | 2009173964 | 8/2009 |
| JP | 2010036210 | 2/2010 |
| KR | 20040056728 | 7/2004 |
| WO | WO0037201 | 6/2000 |
| WO | WO0240727 | 5/2002 |
| WO | WO2005004559 | 1/2005 |
| WO | WO2006127792 | 11/2006 |
| WO | WO2008046219 | 4/2008 |
| WO | WO2009067512 | 5/2009 |
| WO | WO2010108744 | 9/2010 |
| WO | WO2010111701 | 9/2010 |

OTHER PUBLICATIONS

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

International Search Report issued in PCT/US2011/054153, mailed Jun. 13, 2012.

International Search Report issued in PCT/US2011/052354, mailed Mar. 16, 2012.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994) pp. 808-813.

Wolf, S.; R.N. Tauber (1986),Silicon Processing for the VLSI Era: vol. 1—Process Technology. Lattice Press, pp. 531-534, 546.

Kohler, Michael (1999). Etching in Microsystem Technology. John Wiley & Son Ltd. p. 329.

Walker, Perrin; William H. Tarn (1991), CRC Handbook of Metal Etchants. pp. 287-291.

* cited by examiner

PRIOR ART

PRIOR ART

TEMPERATURE REGULATED MELT CRUCIBLE FOR COLD CHAMBER DIE CASTING

FIELD OF THE INVENTION

The present disclosure is generally related to vessels used for melting materials. More particularly, the present disclosure is related to regulating surface temperature of the vessels.

BACKGROUND

When melting a metal alloy, the metal alloy is placed in a crucible and heated. Both the metal alloy and the crucible are heated up simultaneously to provide a molten alloy in the crucible. The interface between the molten alloy and the crucible are at high temperature of the melt. This high temperature allows the molten alloy and the crucible to physically and/or chemically react with each other and to form undesired products. For example, constituent elements from the crucible may be dissolved into the molten alloy and may further react with the metal alloy.

It is desirable to provide a vessel for melting metals or alloys with substantially no interaction between the vessel material and the melting materials. It is also desirable to provide a melting system including such vessel and methods thereof for melting and casting metals or alloys.

SUMMARY

Embodiments described herein relate to a vessel for melting meltable materials. The vessel may be a surface temperature regulated vessel. Embodiments described herein also relate to systems and methods for melting and casting meltable materials using the surface temperature regulated vessel. The meltable materials may include any metals or alloys. The meltable materials may be melted to form molten materials which may then be cast into various articles. In embodiments, the cast articles may be at least partially amorphous. In one embodiment, the cast article may include BMG articles, although non-BMG articles may also be formed.

In accordance with various embodiments, there is provided a vessel including a melting portion and one or more temperature regulating channels. The melting portion may be configured to receive meltable material to be melted therein. The one or more temperature regulating channels may be configured to flow a fluid therein for regulating a temperature at an interface between the melting portion and the meltable material such that the meltable material is substantially non-wetting at the interface.

Preferably, a ceramic with good thermal shock resistance is fabricated with internal cooling lines and then continuously cooled with gas or fluid while alloy is melted on top. An advantage of the vessel of the embodiment herein is to maintain a constant surface temperature at the molten alloy/ceramic interface, preventing substantial wetting and chemical attack of the ceramic by the alloy. Alloy heated on such a regulated ceramic part could then be tilt poured or bottom poured into the cold chamber for die casting.

Optionally, the one or more temperature regulating channels are embedded in the melting portion of the vessel. Optionally, the one or more temperature regulating channels are configured having at least a portion thereof parallel to a height of the melting portion. Optionally, the one or more temperature regulating channels are configured having at least a portion thereof perpendicular to a height of the melting portion. Optionally, the one or more temperature regulating channels are configured such that the temperature at the interface with a body and a bottom of the melting portion are regulated separately. Optionally, the melting portion comprises a body connected to a bottom. Optionally, the bottom is removable or comprises a passage there-through. Optionally, at least the melting portion of the vessel is formed of a material comprising ceramic, a refractory material, or combinations thereof. Optionally, at least the melting portion of the vessel is formed of a ceramic comprising an oxide, nitride, oxynitride, boride, carbide, carbonitride, silicate, titanate, silicide, or combinations thereof. Optionally, at least the melting portion of the vessel is formed of a ceramic comprising silicon oxynitride, silicon carbide, boron carbonitride, titanium boride, zirconium silicate, aluminum titanate, boron nitride, alumina, zirconia, magnesia, silica, tungsten carbide, aluminum oxynitride, yttria, silicon nitride, or combinations thereof. Optionally, at least the melting portion of the vessel is formed of a high thermal shock resistant ceramic. Optionally, the melting portion is a boat, a crucible, or a cup. Optionally, the melting portion is essentially reusable. Optionally, the melting portion comprises a substantially U-shaped structure.

In accordance with various embodiments, there is provided a melting system. The system may include a vessel having a melting portion and one or more temperature regulating channels configured for regulating a temperature at an interface between the melting portion and meltable material such that the meltable material is substantially non-wetting at the interface. The system could further comprise an induction coil positioned adjacent to the melting portion of the vessel to melt the meltable material received in the melting portion. The system could further comprise a mechanical mechanism configured for a tilt pouring of the meltable material from the melting portion.

In accordance with various embodiments, there is provided a melting method. In such a method, a vessel may be obtained including a melting portion configured to receive meltable material to be melted therein, and one or more temperature regulating channels configured to flow a fluid therein. The meltable material may be provided on surface of the melting portion of the vessel and then melted to form a molten material, e.g., using a heat source provided adjacent to the vessel. By flowing the fluid in the one or more temperature regulating channels, a temperature at an interface between the melting portion of the vessel and the molten material may be regulated such that the molten material is substantially non-wetting at the interface. The method could further comprise configuring the vessel to tilt pour or bottom pour the molten material from the melting portion of the vessel.

In accordance with various embodiments, there is provided a casting method. In such a method, a vessel may be obtained including a melting portion configured to receive meltable material to be melted therein, and one or more temperature regulating channels configured to flow a fluid therein. The meltable material may be provided on surface of the melting portion of the vessel and then melted to form a molten material, e.g., using a heat source provided adjacent to the vessel. By flowing the fluid in the one or more temperature regulating channels, a temperature at an interface between the melting portion of the vessel and the molten material may be regulated such that the molten material is substantially non-wetting at the interface. The molten material may then be transferred from the vessel to a casting machine.

Optionally, the temperature at the interface is regulated to be lower than a wetting temperature of the molten material at the interface with the melting portion. Optionally, the temperature at the interface is regulated separately for a body and a bottom of the melting portion. Optionally, the fluid comprises water or gas to flow in the one or more temperature regulating channels. Optionally, the flowing the fluid in the one or more temperature regulating channels continuously cools the melting portion of the vessel. Optionally, the flowing the fluid in the one or more temperature regulating channels maintains a constant temperature at the interface. Optionally, the meltable material comprises an alloy element comprising Zr, Fe, Hf, Cu, Co, Ni, Al, Sn, Be, Ti, Pt, Cu, Ni, P, Si, B, Pd, Ag, Ge, Ti, V, Nb, Zr, Be, Fe, C, B, P, Mn, Mo, Cr, Y, Si, Y, Sc, Pb, Mg, Ca, Zn, La, W, Ru, or combinations thereof. Optionally, melting the meltable material comprises a vacuum induction melting. Optionally, the casting machine comprises a cold chamber die casting machine. Optionally, the molten material is transferred having substantially no contamination from the molten material to surface of the melting portion of the vessel. Optionally, the molten material is transferred having substantially no impurities from the surface of the melting portion of the vessel.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
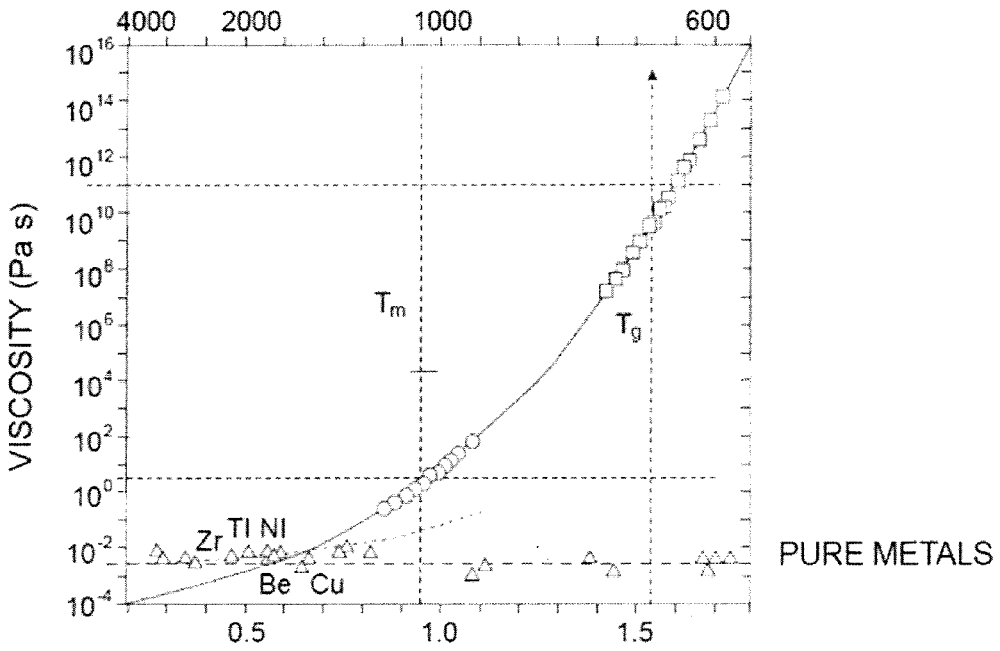
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing under cooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
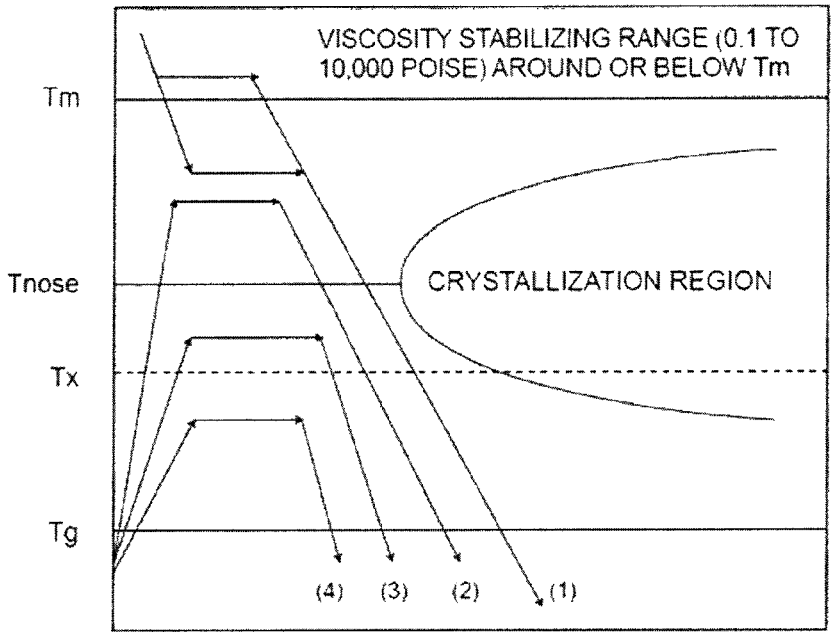
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, barium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x, x')=\langle s(x), s(x')\rangle$ .

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, AL, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(AL)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe 68.00% | Mo 5.00% | Ni 5.00% | Cr 2.00% | P 12.50% | C 5.00% | B 2.50% | |
| 2 | Fe 68.00% | Mo 5.00% | Ni 5.00% | Cr 2.00% | P 11.00% | C 5.00% | B 2.50% | Si 1.50% |
| 3 | Pd 44.48% | Cu 32.35% | Co 4.05% | P 19.11% | | | | |
| 4 | Pd 77.50% | Ag 6.00% | Si 9.00% | P 7.50% | | | | |
| 5 | Pd 79.00% | Ag 3.50% | Si 9.50% | P 6.00% | Ge 2.00% | | | |
| 6 | Pt 74.70% | Cu 1.50% | Ag 0.30% | P 18.0% | B 4.00% | Si 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr 41.20% | Ti 13.80% | Cu 12.50% | Ni 10.00% | Be 22.50% | |
| 2 | Zr 44.00% | Ti 11.00% | Cu 10.00% | Ni 10.00% | Be 25.00% | |
| 3 | Zr 56.25% | Ti 11.25% | Cu 6.88% | Ni 5.63% | Nb 7.50% | Be 12.50% |
| 4 | Zr 64.75% | Ti 5.60% | Cu 14.90% | Ni 11.15% | Al 2.60% | Be 1.00% |
| 5 | Zr 52.50% | Ti 5.00% | Cu 17.90% | Ni 14.60% | Al 10.00% | |
| 6 | Zr 57.00% | Nb 5.00% | Cu 15.40% | Ni 12.60% | Al 10.00% | |
| 7 | Zr 50.75% | Cu 36.23% | Ni 4.03% | Al 9.00% | | |
| 8 | Zr 46.75% | Ti 8.25% | Cu 7.50% | Ni 10.00% | Be 27.50% | |
| 9 | Zr 21.67% | Ti 43.33% | Ni 7.50% | Be 27.50% | | |
| 10 | Zr 35.00% | Ti 30.00% | Cu 7.50% | Be 27.50% | | |
| 11 | Zr 35.00% | Ti 30.00% | Co 6.00% | Be 29.00% | | |
| 12 | Zr 35.00% | Ti 30.00% | Fe 2.00% | Be 33.00% | | |
| 13 | Au 49.00% | Ag 5.50% | Pd 2.30% | Cu 26.90% | Si 16.30% | |
| 14 | Au 50.90% | Ag 3.00% | Pd 2.30% | Cu 27.80% | Si 16.00% | |
| 15 | Pt 57.50% | Cu 14.70% | Ni 5.30% | P 22.50% | | |
| 16 | Zr 36.60% | Ti 31.40% | Nb 7.00% | Cu 5.90% | Be 19.10% | |
| 17 | Zr | Ti | Nb | Cu | Be | |

TABLE 2-continued

| Additional Exemplary amorphous alloy compositions (atomic %) | | | | | | |
|---|---|---|---|---|---|---|
| Alloy | Atm % | Atm % | Atm % | Atm % | Atm % | Atm % |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}AL_5Ga_2P_{11}C_6B_4$. Another example is $Fe_{72}AL_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Co4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Embodiments described herein relate to a vessel for melting meltable materials. The vessel may be a surface temperature regulated vessel. Embodiments described herein also relate to systems and methods for melting and casting meltable materials using the vessel. The meltable materials may include any metals or alloys. The meltable materials may be melted to form molten materials which can be cast into various articles. In embodiments, the cast articles may be at least partially amorphous. In one embodiment, the cast article may include BMG articles, although non-BMG articles may also be encompassed in the present disclosure.

As disclosed herein, the vessel may be a surface temperature regulated vessel for providing a substantially non-wetting interface with the molten materials. In one embodiment, the vessel may include a melting portion configured to receive meltable material to be melted therein. The vessel may further include one or more temperature regulating channels configured to flow a fluid therein for regulating a surface temperature of the vessel, for example, a temperature at the interface between the melting portion of the vessel and the molten material such that the molten material is substantially non-wetting at the interface.

In one example, a vessel for melting meltable materials may be fabricated or obtained having temperature regulating channels embedded therein, and then continuously cooled by circulating a fluid in these channels when meltable materials (e.g., metals or alloys) are melted on surface of the vessel. While the meltable materials are melting, e.g., at a melting temperature Tm or greater, the surface temperature, e.g., at the interface between the molten material and the vessel, may be controlled or regulated to maintain constant for preventing substantial wetting and chemical/physical attack or any kind of interactions between the vessel materials and the molten materials. In embodiments, the substantially non-wetting molten materials may then be tilt poured or bottom poured into a casting machine, for example, a cold chamber die casting machine.

As used herein, the term "wetting" refers to spreading of a fluid, for example, a liquid such as a melt, on a solid surface. In an embodiment, the spreading of the fluid on the solid surface is implemented by displacing air adsorbed thereto. The solid surface may be, e.g., surface of a vessel such as a chamber, a boat, a cup, a crucible, etc. The wetting may be characterized by wetting temperature and/or wetting angle. Wetting could be characterized by the contact angle between the liquid and the solid surface. A contact angle less than 90° (low contact angle) usually indicates wetting of the surface is favorable, and the fluid will "wet" and spread over a large area of the surface such that there is "wetting." Contact angles greater than 90° (high contact angle) means that wetting of the surface is unfavorable so the fluid will minimize contact with the surface such that there is "no wetting" or "non-wetting" and form a compact liquid droplet. A liquid can be "wetting" on one solid surface and "non-wetting" on another solid surface.

The reaction may refer to various types of reactions. For example, it can refer to dissolution of the elements of the vessel into the molten alloy, causing contamination of the molten alloy by the constituent elements of the vessel. Dissolution can involve the breakdown of the crystals that make up the vessel and the diffusion of those elements into the molten alloy. It can also refer to diffusion of the molten alloy into the vessel. Diffusion can involve diffusive transport of the elements of the alloy (charge) into the grains (or crystals) and/or grain boundaries in the vessel. In some cases it can also refer to the production of crystalline phases, which contain elements from both the molten alloy and the vessel at the interface between the two. These crystalline phases can be oxides, nitrides, carbides, etc., or they can be intermetallics. They may also be transported from the interface into the bulk of the molten alloy by stirring, causing further contamination.

The "attack" (or "contamination") may be quantified by either measuring the concentration of impurity elements in the final melted alloy (indicating the degree to which the elements including the vessel have entered the alloy) or by the deviation of the main elements of the final melted alloy from the desired nominal composition (indicating diffusion of alloy elements into the vessel). This can involve measurement of the alloy composition and comparison with the nominal composition in terms of both the main constituents and also impurity elements, such as oxygen, carbon, nitrogen, sulfur, hydrogen, and the elements of the inner container. The tolerance for impurity elements depends on the actual alloy composition being melted. Moreover, one additional measure of "attack" could also be the thickness of the wall of vessel after processing, indicating whether substantial amounts of the container material have dissolved into the molten alloy.

The wetting temperature may be raised or lowered depending on the wetting conditions at the interface between the molten material and the solid surface of a vessel. The wetting conditions may be determined by, e.g., compositions of the meltable material and the underlying solid surface, surface properties of the solid surface, interactions between the molten material and the underlying solid surface, pressure or vacuum, etc. However, for a pre-defined melting system, the wetting conditions may be pre-defined and the wetting temperature may be pre-defined.

The term "wetting angle" is a measure of the affinity of a liquid (e.g., the molten material) for a solid surface. The wetting angle of the liquid is greater than 90° for at a substantially non-wetting interface with a solid surface and less than 90° for wetting liquids. If substantially non-wetting, liquids will not spread on the solid surface, in some case, liquids may tend to bead up. In an exemplary embodiment, the wetting angle of molten alloys on the disclosed vessel surface may be greater than 90°, for example between 90° and 180°, such as about 180° meaning there is no wetting.

As disclosed herein, by regulating surface temperature of the vessel, molten materials may be substantially non-wetting on the vessel surface. In other words, molten materials may have a substantially non-wetting interaction with the vessel surface. For example, molten materials will not spread and nor have any interaction, e.g., physical and/or chemical reactions that a wetting surface may have, with the vessel surface. The substantially non-wetting interface may prevent interdiffusion and/or contamination between the elements from the alloy and those of the vessel material. For example, the molten, heated alloy charge, may be at least substantially free of the elements diffused from the vessel.

In one embodiment, the presently provided vessels and their methods may substantially prevent the molten alloy charge or individual elements inside the molten alloy from reacting with the vessel materials at the interface between the two. As a result, minimum trace amount or substantially zero amount of the alloy may be observed on the vessel surface after the molten alloy is removed from the vessel and/or transferred for further process. Molten materials may be removed from the vessel surface with improved consistency and minimum impurities and with a minimum of residue being left behind. In contrast, if surface temperature of the vessel is not regulated, the molten material may be spread on the vessel surface, and physical interaction/reaction (e.g., adsorption) between the alloy and the vessel elements or chemical interaction/reaction (e.g., chemical reaction) may occur, leaving alloy residues on the vessel surface or having impurities in the molten alloy from vessel elements.

Further, the substantially non-wetting interface may allow molten materials easily and cleanly removed from the vessel surface. The vessel may be essentially reusable, e.g., without any additional cleaning processes. That is, the reliability and reusability of the vessels are improved by regulating the temperature at the interface.

Exemplary vessels may be a container in a form of, for example, a boat, a cup, a crucible, etc. The vessels may have any desirable geometry with any shape or size. For example, it may be cylindrical, spherical, cubic, rectangular, and/or an irregular shape.

The vessels may be formed of a ceramic. Exemplary ceramic may include at least one element selected from Groups IVA, VA, and VIA in the Periodic Table. The ceramic may include a thermal shock resistant ceramic or other ceramics. Specifically, the element can be at least one of Ti, Zr, Hf, Th, Va, Nb, Ta, Pa, Cr, Mo, W, and U. In one embodiment, the ceramic may include an oxide, nitride, oxynitride, boride, carbide, carbonitride, silicate, titanate, silicide, or combinations thereof. For example, the ceramic can include, silicon nitride, silicon oxynitride, silicon carbide, boron carbonitride, titanium boride ($TiB_2$), zirconium silicate (or "zircon"), aluminum titanate, boron nitride, alumina, zirconia, magnesia, silica, tungsten carbide, or combinations thereof. The ceramic may or may not include thermal shock sensitive ceramic, for example, yttria, aluminum oxynitride (or "sialon"), etc. The vessels may be formed of a material insensitive to radio frequency (RF) as in that used in induction heating. Alternatively, a material sensitive to RF can be used.

In embodiments, the vessel may be formed of a refractory material. A refractory material may include refractory metals, such as molybdenum, tungsten, tantalum, niobium, rehenium, etc. Alternatively, the refractory material may include a refractory ceramic. The ceramic can be any of the aforementioned ceramics, including silicon nitride, silicon carbide, boron nitride, boron carbide, aluminum nitride, alumina, zirconia, titanium diboride, zirconium silicate, aluminum silicate, aluminum titanate, tungsten carbide, silica, and/or fused silica. In embodiments, the vessels may be formed of any commercially available materials known in the art that are suitable for alloying and/or melting.

The vessels may have the ability to absorb electromagnetic energy and convert it to heat, which may sometimes be designed to be re-emitted as infrared thermal radiation. This energy may be radio frequency or microwave radiation used in industrial heating processes and also occasionally in microwave cooking. The vessels may be formed of silicon carbide, stainless steel, and/or any other electrically conductive materials.

In one embodiment, the inner surface of the vessel for melting materials may be pre-treated. For example, a graphite-containing vessel may be pre-treated with a coating of Zr or Si powder, or Zr- or Si-containing compounds that react with carbon such that the vessel is essentially non-conductive. The vessel may then be heated under vacuum to force the powder to react with the vessel, forming zirconium or silicon carbide. The pre-treated vessel may be used to, e.g., melt alloy feedstock, minimizing carbon addition to alloy from the graphite.

Meltable materials, e.g., metals and/or alloys, may be melted in a vessel, e.g., in a non-reactive environment, to prevent any reaction, contamination or other conditions which might detrimentally affect the quality of the resulting articles. The metals or alloys may be melted in a vacuum environment or in an inert environment, e.g., argon. In some cases, since any gasses in the melting environment may become entrapped in the molten material, the metals or alloys may be melted in a vacuum environment. For example, a vessel may be used as a melt chamber coupled to a vacuum source in which metals or alloys are melted. In embodiments, single charges or multiple charges of meltable materials at once may be melted in the vessel.

In embodiments, an induction vessel may be used in a vacuum to inductively melt metals and/or alloys, e.g., using induction skull remelting or melting, vacuum induction melting (VIM), electron beam melting, resistance melting or plasma arc, etc.

The vessel may be connected to a heat source for melting meltable materials. The heat source may be any suitable heat source. For example, the heat source may be an inductive heating coil surrounding at least a portion of the vessel. The inductive heating coil may be coupled to a power source to generate a field that passes through the vessel, and heats and melts meltable materials located within the vessel. In some cases, the field also serves, e.g., to agitate or stir the molten metal alloys. In embodiments, the heating may be carried out in under a partial vacuum, such as low vacuum, or even high vacuum, to avoid reaction of the alloy with air. In one embodiment, the vacuum environment can be at about 10-2 torr or less, such as at about 10-3 torr or less, such as at about 10-4 torr or less.

The vessel may further include one or more of temperature regulating channels configured to flow a fluid such as a liquid or a gas therein to regulate a temperature, e.g., at the interface of the vessel and the molten material. The temperature regulating channels, e.g., fowled of copper or other thermal conductive materials, may provide passages for circulating the fluid from and to a fluid source to pull out or extract heat from the vessel, to prevent melting of the vessel and to control the surface temperature as desired of the vessel. The temperature regulating channels may be retained in position next to one another. The temperature regulating channels may be embedded within the vessel walls.

By controlling the cooling conditions of the temperature regulating channels and the heating process of the meltable material in the vessel, the temperature at the interface between the meltable material and the vessel surface may be controlled, for example, to be less than a wetting temperature of this melting system and/or less than the temperature of the heated metals or alloys. The temperature regulated interface may provide a substantially non-wetting interaction at such interface. The molten materials may be easily poured and/or transferred from the vessel surface. For example, molten materials may be tilt poured or bottom poured from the vessel.

Apparatus and Methods

Figure 3:
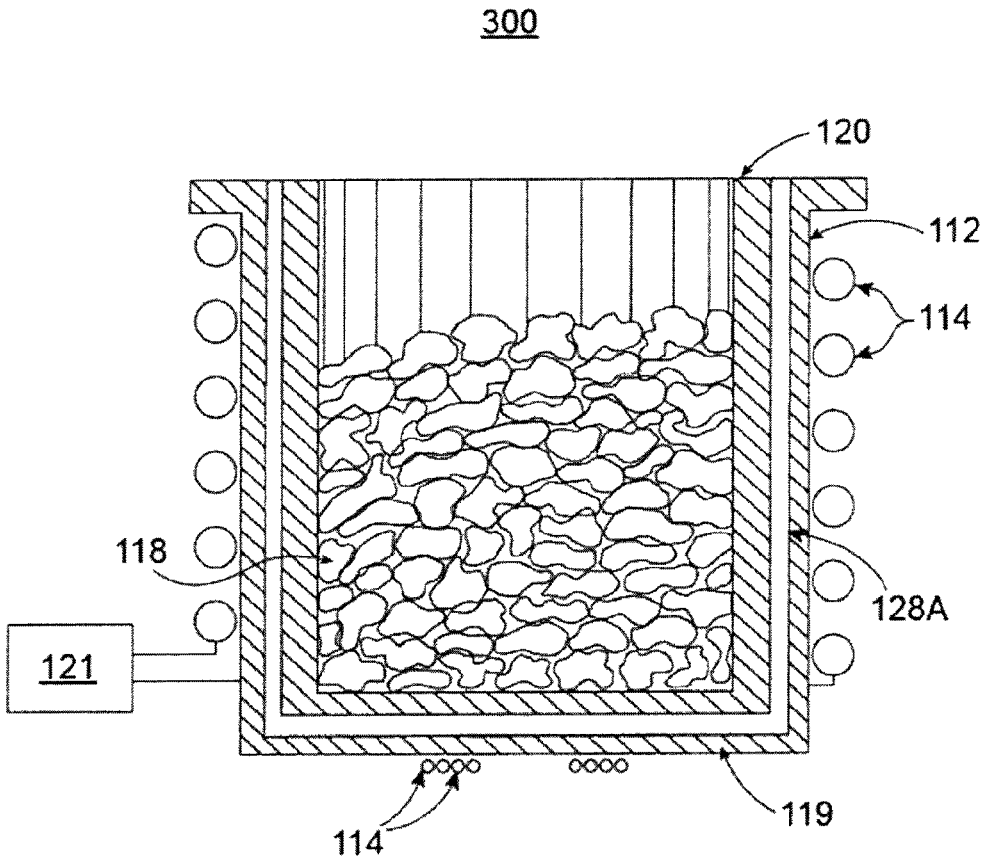
FIG. 3 depicts an exemplary melting system according to various embodiments of the present teachings.
Figure 4:
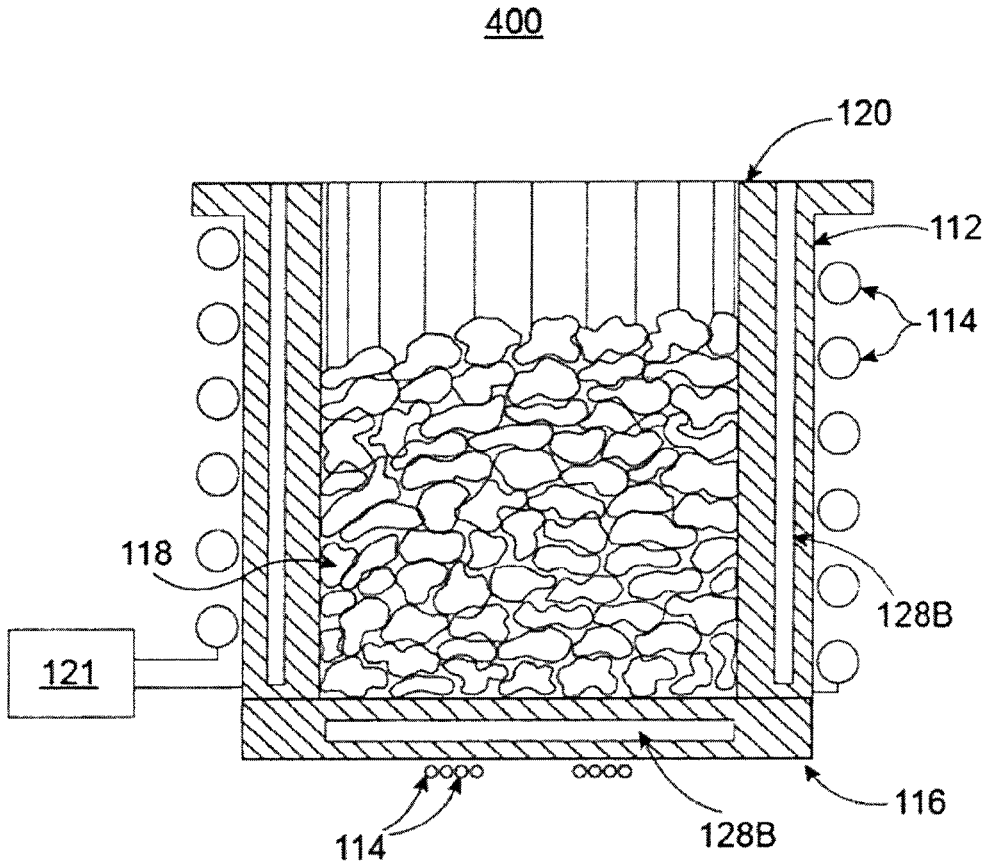
FIG. 4 depicts another exemplary melting system according to various embodiments of the present teachings.
Figure 5:
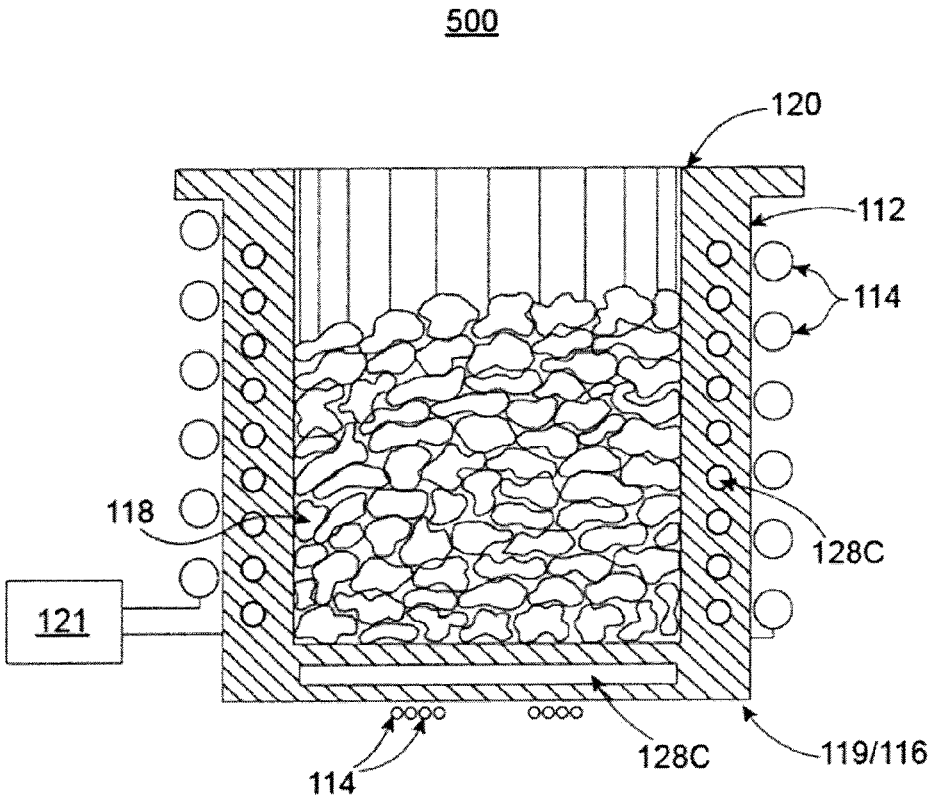
FIG. 5 depicts an additional exemplary melting system according to various embodiments of the present teachings.

FIGS. 3-5 depict exemplary melting systems in accordance with various embodiments of the present teachings. Note that FIGS. 3-5 are merely a schematic, and alternative versions of the design can exist.

In FIG. 3, melting system 300 may include a vessel having a melting portion defined by a body 112 and a bottom 119, temperature regulating channels 128*a*, and/or a cover 120.

The melting portion defined by the body 112 and the bottom 119 may have desired thermal and electrical conductivity. While the vessel in FIG. 3 may have any shape acceptable for use in induction melting, in one embodiment, the vessel may be generally shaped as a hollow cylinder. The vessel depicted in FIG. 3 may be an induction crucible, for example.

A plurality of induction coils 114 may be positioned about the melting portion including the body 112 and/or the bottom 119 of the vessel, which can be heated using a power source 121. Induction coils 114 may serve as a heat source to melt the meltable material 118, e.g., metal or alloy charge(s), placed within the melting portion of the vessel and maintain a molten state. The meltable material 118 may include any possible alloys, for example, Zr-based, Fe-based, Ti-based, Pt-based, Pd-based, gold-based, silver-based, copper-based, Ni-based, Al-based, Mo-based, Co-based alloys, and/or the like, as discussed above. The metal/alloy charge(s) may take any forms, which may include, but are not be limited to, lumps, ingots, granules, plates, powders, and mixtures thereof. Those skilled in the art will understand that the amount of metal charge(s) placed the vessel may vary depending on intended use. Once meltable materials 118 (e.g., metal charge (s)) are placed inside the vessel, the cover 120, which in one embodiment, may be made from the same material as the melting portion defined by the body 112 and the bottom 119, may be positioned on top of the body 112 and held in place to ensure vessel is sealed. Power source 121 may be turned on and metal charges may be melted when the appropriate temperature is attained. The electromagnetic field generated by the induction coils 114 may cause the metal charge(s) to heat itself internally due to resistance heating caused by current flow within the metal charge(s). Power levels and frequencies applied to the coil may be selected as desired.

Temperature regulating channels 128*a* may be positioned, e.g., embedded, within the melting portion of the vessel including the body 112 and the bottom 119. The temperature regulating channels 128*a* may be configured in a manner that at least a portion of the channels 128*a* is parallel to a height of the melting portion of the vessel. The vessel may then be water-cooled or gas-cooled by the temperature regulating channels 128*a* to prevent itself from melting during heating of the meltable material 118. Further, the temperature regulating channels 128*a* may be configured to regulate surface temperature of the melting portion of the vessel, e.g., at the interface with the meltable material 118 at least while melting. The temperature may be regulated consistently and continuously. The regulated temperature at the interface may provide substantially non-wetting interface between the molten material and the vessel surface.

In some embodiments, molten materials in the vessel may then be poured out from the vessel, for example, tilt poured into a second vessel and/or into a casting machine for further process. For example, the vessel may be mounted for translation and for pivotal movement about a pouring axis, which is in turn mounted to a motor for rotating the vessel to pour molten materials there-from into a casting machine, e.g., through a pour hole of a shot sleeve, with or without a pour cup or funnel coupled to the shot sleeve, e.g., for a die casting.

In other embodiments, molten materials in the vessel may be poured out from bottom of the vessel, for example, bottom poured into a second vessel and/or into a casting machine for further process. Accordingly, a bottom 116 as shown in FIG. 4, that is removable (e.g., a sliding bottom plate) or otherwise provides a passage (e.g., a hole) there-through, may be included in a vessel. The bottom 116 and body 112 may be connected to define a melting portion of the vessel. The bottom 116 and body 112 may be formed using the same or different materials. The bottom 16 may function, for example, by sliding, rotating, dropping and the like. In one embodiment, the bottom 116 may be water-cooled or gas-cooled using the same or separate circulating paths as for the body 112, by suitably configuring the temperature regulating channels 128*b*. In some embodiments, temperature regulating channels 128*b* may be configured having a continuous cooling path through the body 112 and the bottom 116. Concurrent with melting the meltable materials 118 in the vessel, the temperature regulating channels 128*b* may be used to regulate a temperature at the interface of the melting portion of the vessel (i.e., defined by the bottom 116 and the body 112) with the molten material and to provide a substantially non-wetting interface.

In embodiments, in addition to the configurations shown in FIGS. 3-4, the temperature regulating channels may have various other configurations. For example, temperature regulating channels may be configured in a manner that at least a portion of the channels is perpendicular to a height of the vessel, which may be functioned for tilt pouring (e.g., see FIG. 5) and/or bottom pouring (not shown) materials there-from. The temperature regulating channels 128*c* in FIG. 5 is configured at least having a portion surrounding the body 112 in a direction perpendicular to the height of the melting portion defined by the body 112 and the bottom 119. The temperature regulating channels 128*c* may also be embedded within the bottom 119, for example, configured the same or similarly as depicted in FIGS. 3-4. In embodiments, the bottom in FIGS. 3-5 may or may not be separately cooled or regulated.

Another embodiment (not shown in a figure) could be a combination of the embodiments of FIGS. 4 and 5, comprising a vessel having a bottom pour and internal cooling. Such an embodiment could provide the benefits of both of the embodiments of FIGS. 4 and 5.

Regardless of the configurations of the temperature regulating channels within the vessels, the temperature at the interface of the meltable/molten material and surface of the melting portion of the vessel may be regulated to provide a substantially non-wetting interface. For example, as alloy charges begin to melt in a vessel (e.g., as shown in FIGS. 3-5), the resulting molten alloy may become suspended or significantly lack of interaction, e.g., physical/chemical reaction, with the melting portion of the vessel due to the regulated substantially non-wetting interface. In some embodiments, this suspension of molten alloy or the substantially non-wetting surface can prevent formation of a skull.

In embodiments, when pouring and/or transferring molten materials from the vessel, e.g., into a casting machine such as a cold chamber die casting machine, the electromagnetic field generated by induction coils 114 (e.g., see FIGS. 3-5) may maintain the material molten, and the temperature regulating channels 128 may continuously regulate the interface temperature when the molten material is in contact with the vessel surface.

The above embodiments are for illustrative purposes only and are not meant to be limiting. In embodiments, the materials for melting may include any types of alloys. In one embodiment, the meltable materials may be alloys for forming BMG articles using the apparatus and methods shown in FIGS. 3-5.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A vessel comprising:

a melting portion configured to receive meltable material to be melted into a molten material therein;

an inner surface that contacts the molten material; and one or more temperature regulating fluid flow channels configured to flow a fluid therein for regulating a temperature of the inner surface such that the temperature of substantially whole of the inner surface is regulated; wherein the inner surface comprises ceramic or refractory material, wherein the vessel is essentially not electrically conductive; further comprising an induction coil positioned adjacent to the melting portion of the vessel to melt the meltable material received in the melting portion, wherein the vessel is insensitive to radio frequency and wherein a molten metal or a molten metal alloy does not substantially wet the inner surface.

2. The vessel of claim 1, wherein the one or more temperature regulating fluid flow channels are embedded in the melting portion of the vessel.

3. The vessel of claim 1, wherein the one or more temperature regulating fluid flow channels are configured having at least a portion thereof parallel to a height of the melting portion.

4. The vessel of claim 1, wherein the one or more temperature regulating fluid flow channels are configured having at least a portion thereof perpendicular to a height of the melting portion.

5. The vessel of claim 1, wherein the one or more temperature regulating fluid flow channels are configured such that the temperature at the inner surface with a body and a bottom of the melting portion are regulated separately.

6. The vessel of claim 1, wherein the melting portion comprises a body connected to a bottom.

7. The vessel of claim 6, wherein the bottom is removable or comprises a passage there-through.

8. The vessel of claim 1, wherein the ceramic or refractory material comprises silicon oxynitride, silicon carbide, boron carbonitride, titanium boride, zirconium silicate, zirconium carbide, aluminum titanate, boron nitride, alumina, zirconia, magnesia, silica, tungsten carbide, aluminum oxynitride, yttria, silicon nitride, or combinations thereof.

9. A system comprising:

a vessel comprising a melting portion configured to receive meltable material to be melted therein to form a molten material; an inner surface that contacts the molten material; and one or more temperature regulating fluid flow channels configured to flow a fluid therein for regulating a temperature of the inner surface such that the temperature of substantially whole of the inner surface is regulated; wherein the inner surface comprises ceramic or refractory material; further comprising an induction coil positioned adjacent to the melting portion of the vessel to melt the meltable material received in the melting portion, wherein the vessel is insensitive to radio frequency and wherein a molten metal or a molten metal alloy does not substantially wet the inner surface.

10. The system of claim 9, wherein the vessel is configured for a tilt pouring of the molten material from the melting portion.

11. The system of claim 9, wherein the vessel is configured to tilt pour or bottom pour the molten material from the melting portion of the vessel.

12. The system of claim 9, wherein the temperature at the inner surface is regulated separately for a body and a bottom of the melting portion.

13. A system of claim 9, further comprising a casting machine.

14. The system of claim 13, wherein the casting machine comprises a cold chamber die casting machine.

15. The system of claim 13, wherein the molten material is transferred having substantially no contamination from the molten material to surface of the melting portion of the vessel.

16. The system of claim 13, wherein the molten material is transferred having substantially no impurities from the surface of the melting portion of the vessel.

17. The system of claim 13, wherein the molten material comprises a metal alloy to form a BMG article in the casting machine.

* * * * *